US006701841B2

(12) United States Patent
Tsurumaki

(10) Patent No.: US 6,701,841 B2
(45) Date of Patent: Mar. 9, 2004

(54) SHEET DISCHARGE UNIT

(75) Inventor: Takeshi Tsurumaki, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/782,219

(22) Filed: Feb. 14, 2001

(65) Prior Publication Data

US 2001/0015144 A1 Aug. 23, 2001

(30) Foreign Application Priority Data

Feb. 22, 2000 (JP) ..... P2000-044898

(51) Int. Cl.[7] ..... B65H 29/38

(52) U.S. Cl. ..... 101/419; 101/416.1; 101/420; 271/188; 400/647; 400/647.1

(58) Field of Search ..... 271/188, 209; 101/416.1, 419, 417, 420; 400/647, 647.1

(56) References Cited

U.S. PATENT DOCUMENTS

| | | | | | |
|---|---|---|---|---|---|
| 5,890,822 | A | * | 4/1999 | Saikawa et al. | 101/419 |
| 5,946,016 | A | * | 8/1999 | Saito et al. | 271/188 |
| 5,975,521 | A | * | 11/1999 | Ono et al. | 271/188 |
| 6,238,114 | B1 | * | 5/2001 | Bennett et al. | 101/420 |
| 6,270,215 | B1 | * | 8/2001 | Miyasaka et al. | 347/104 |
| 6,322,068 | B1 | * | 11/2001 | Iemura et al. | 271/177 |
| 6,345,782 | B1 | * | 2/2002 | Nakayama et al. | 242/564.4 |
| 6,503,011 | B2 | * | 1/2003 | Kono | 400/646 |

FOREIGN PATENT DOCUMENTS

| | | |
|---|---|---|
| EP | 0872442 | 10/1998 |
| EP | 11292371 | 10/1999 |
| EP | 1076027 | 2/2001 |
| JP | 01139465 | 5/1989 |
| JP | P06-239000 | 8/1994 |
| JP | 06239000 | 8/1994 |
| JP | 11079518 | 3/1999 |
| JP | 2001058751 | 3/2001 |

* cited by examiner

*Primary Examiner*—Andrew H. Hirshfeld
*Assistant Examiner*—Kevin D. Williams
(74) *Attorney, Agent, or Firm*—Nath & Associates PLLC; Marvin C. Berkowitz

(57) ABSTRACT

A sheet discharge unit has a transfer passage 3 for transferring a sheet of printed paper 2 toward a sheet receiving tray 20, and a pair of left and right jump wings 11, 11 located at both sides of the transfer passage 3 and moveable between a guide position in which the jump wings protrude upward from a bottom wall of the transfer passage and await position in which the jump wings are retracted below the bottom wall. In one embodiment, each of the jump wings 11, 11 comprises divided wing components laterally spaced in a direction S perpendicular to a sheet transfer direction T. In an alternative embodiment, each of the jump wings comprises a unitary body having a plurality of convex segments and a plurality of concave recesses which are alternately located in the direction S.

20 Claims, 15 Drawing Sheets

SHEET DISCHARGE UNIT

BACKGROUND OF THE INVENTION

The present invention relates to a sheet discharge unit for transferring a sheet of pre-treated paper such as a printed paper toward a paper receiving tray and, more particularly, to a sheet discharge unit for use in a printing machine.

Considerable research and development work has been undertaken in the pasts to provide sheet discharge units, one typical example of which is shown in FIG. 15. In FIG. 15, a sheet discharge unit 100 has a transfer passage 102 through which a sheet of printed paper 101 is conducted to a paper receiving tray 107, and a pair of transfer belts 103, 103 are located at a center of the transfer passage 102. The transfer belts 103, 103 move between a sheet transfer starting position and a sheet transfer terminating position. Also, a bottom wall 102*a* of the transfer passage 102 has a large number of suction bores 104 through which air remaining in the vicinity of the transfer passage 102 is drawn downward such that the sheet 101 is urged toward the transfer belt 103. A pair of left and right jump wings 105, 105 are located in the sheet transfer terminating position at both sides of the transfer belts 103, 103. The pair of jump wings 105, 105 are freely moveable in a pair of guide openings 106, respectively, between a guide position (as shown in FIG. 15) in which the jump wings 105, 105 protrude upward from the bottom surface 102*a* and a wait position in which the jump wings 105, 105 are retracted downward from the bottom wall 102*a*. An upper surface 105*a* of each jump wing 105 is gradually inclined upward along the sheet transfer direction and has a three-dimensional inclined profile wherein each jump wing 105 is gradually inclined from an inside toward an outside. The paper receiving tray 107 is located at a position downstream side of the sheet transfer terminating position and at a position lower than the sheet transfer terminating position. Side fences 108 are mounted at both sides of the paper receiving tray 107, respectively, and an end fence is mounted at a distal end of the paper receiving tray 107.

With such a structure, when the printed sheet 101 is conducted on the sheet transfer starting position of the transfer passage 102, the printed sheet 101 is sucked with air toward the bottom surface 102*a* of the transfer passage 102 and is urged toward the transfer belts 103, 103. The printed sheet 101 that is urged on the transfer belts 103, 103 is transferred to the sheet transfer terminating position by the transfer belts 103. Here, when the printed sheet 101 to be transferred has a low rigidity, the pair of jump wings 105, 105 are moved to the guide position as shown in FIG. 15. When this occurs, the printed sheet 101 is guided upward at both sides thereof with the pair of jump wings 105, 105 such that the printed sheet 101 is discharged under a state wherein both sides of the printed sheet 101 is curved upward from a central portion. Then, the printed sheet 101 has an increased apparent rigidity and traces a stable dropping trajectory to be dropped to the paper receiving tray 107. In contrast, when the printed sheet 101 to be discharged has a strong rigidity, the pair of jump wings 105, 105 are located in the wait position. In this event, the printed sheet 101 is discharged in a stable dropping state owing to its property of strong rigidity.

Related technologies of the conventional sheet discharge unit 100 discussed above are disclosed in Japanese Patent Application Laid-Open Publication No. H6-239000.

SUMMARY OF THE INVENTION

In the conventional sheet discharge unit 100, however, since the pair of left and right jump wings 105, 105 are laterally separate from one another with a sufficiently desired width to cope with printed sheets of various sizes and all of upper surfaces 105*a*, 105*a* of the jump wings 105, 105 tend to be brought into contact with surfaces of the printed sheets 101, there exists a relatively large running resistance caused in the printed sheet 101, resulting in a difficulty in discharging the printed sheet to a normal final dropping position. Also, when the printed sheet 101 has the large running resistance, a large amount of paper dust or paper powder is produced owing to wear of the paper. Particularly, the printed sheet 101 is forcedly curved on the left and right jump wings 105, 105 and, therefore, a large running resistance is applied to the printed sheet 101. If, in this instance, the width of the left and right jump wings 105, 105 is decreased with a view to decreasing the running resistance, then, it becomes difficult for the sheet discharge unit to cope with the printed sheet of various sizes.

It is therefore an object of the present invention to provide a sheet discharge unit which can cope with sheets of paper of various sizes and which can reduce running resistance of the sheet of paper and the amount of paper dust or paper powder to be produced from the paper.

A sheet discharge unit of the present invention is provided with: a paper receiving tray; a transfer passage transferring a sheet of pre-treated paper to the paper receiving tray along a sheet transfer direction; guide openings formed at both sides of the transfer passage; a transfer member located in the transfer passage to impart a force to the sheet of pre-treated paper so as to move the sheet of pre-treated paper in the sheet transfer direction; jump wings respectively disposed in the guide openings, and having convex and concave portions arranged in a direction substantially perpendicular to the sheet transfer direction; and actuating member actuating the jump wings between a guide position in which the jump wings respectively protrude upward from the guide openings and a wait position in which the jump wings are retracted into the guide openings.

More specifically, according to one aspect of the invention, there is provided a sheet discharge unit having a transfer passage for transferring a sheet of pre-treated paper along a sheet transfer direction toward a paper receiving tray and having a bottom surface. The sheet discharge unit comprises a pair of left and right jump wings freely moveable between a guide position in which the jump wings protrude upward from the bottom surface of the transfer passage and a wait position in which the jump wings is retracted from the bottom surface of the transfer passage. Each of the left and right jump wings includes a plurality of divided wing components which are laterally spaced from one another in a direction perpendicular to the sheet transfer direction such that, when the jump wings remain in the guide position, the sheet of pre-treated paper is guided upward at both sides thereof to form a curved dropping state and is discharged to the paper receiving tray and, when the jump wings remain in the wait position, the sheet of pre-treated paper is not curved at the both sides thereof and is discharged to the paper receiving tray.

Besides, according to another aspect of the present invention, there is provided a sheet discharge unit having a transfer passage for transferring a sheet of pre-treated paper along a sheet transfer direction toward a paper receiving tray and having a bottom surface. The sheet discharge unit comprises a pair of left and right jump wings freely moveable between a guide position in which the jump wings protrude upward from the bottom surface of the transfer passage and a wait position in which the jump wings remain beneath the bottom surface of the transfer passage. Each of the left and right jump wings includes convex segments for guiding the sheet of pre-treated paper and concave recesses which are out of contact with the sheet of pre-treated paper, the convex segments and the concave recesses being alternately located in a direction perpendicular to the sheet transfer direction such that, when the jump wings remain in the guide position, the sheet of pre-treated paper is guided upward at both sides thereof to form a curved dropping state and is discharged to the paper receiving tray and, when the jump wings remain in the wait position, the sheet of pre-treated paper is not curved at the both sides thereof and is discharged to the paper receiving tray.

Other aspect and advantages of the invention will become more apparent from the following description, taken in conjunction with the accompanying drawings, illustrating by way of example the principles of the invention.

DETAILED DESCRIPTION OF THE PREFERRED EMBODIMENTS

Figure 1:
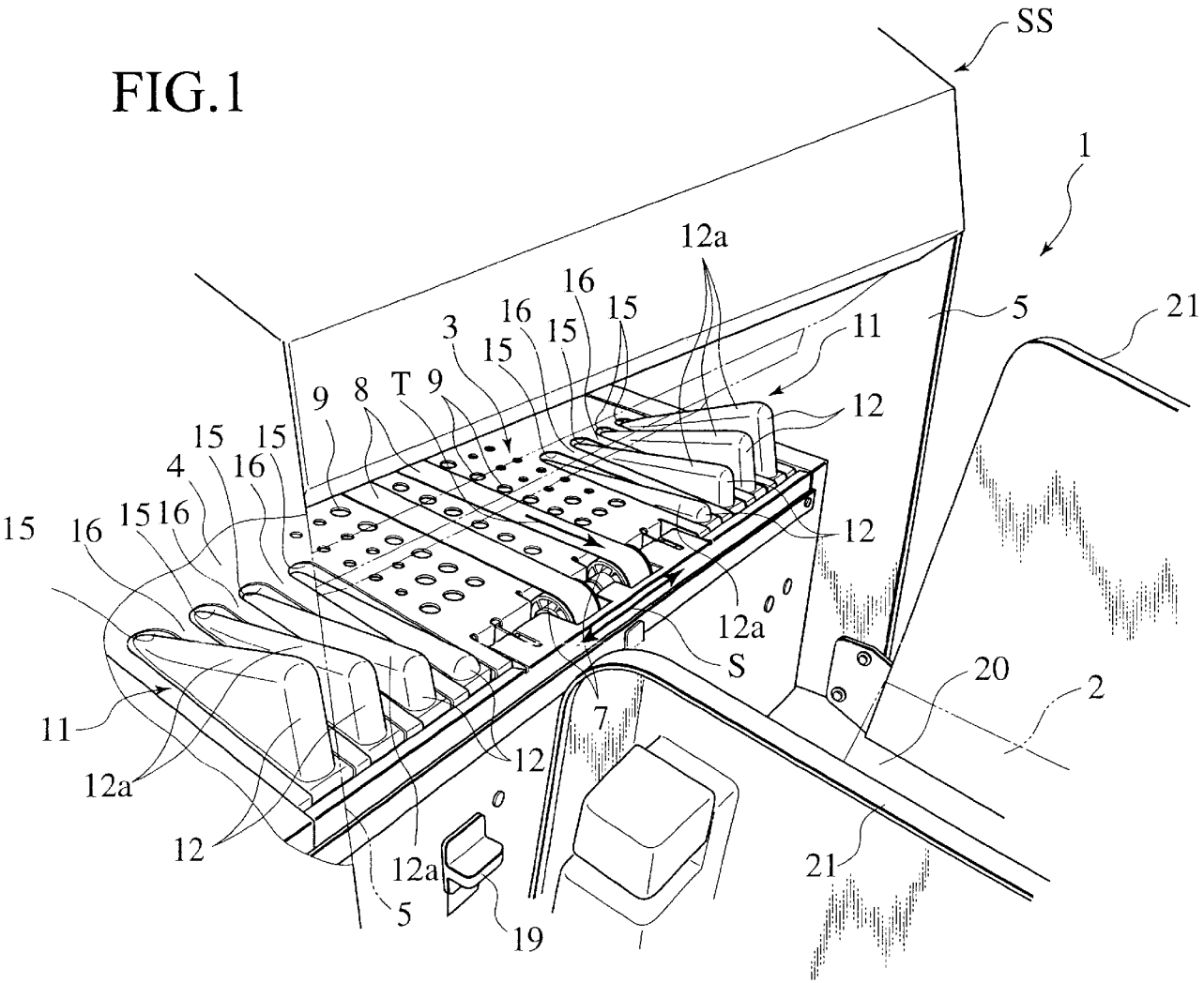
FIG. 1 is an exploded perspective view of a preferred embodiment of a sheet discharge unit according to the present invention, wherein the sheet discharge unit is shown as being applied to a sheet discharge section of a printing machine.
Figure 2:
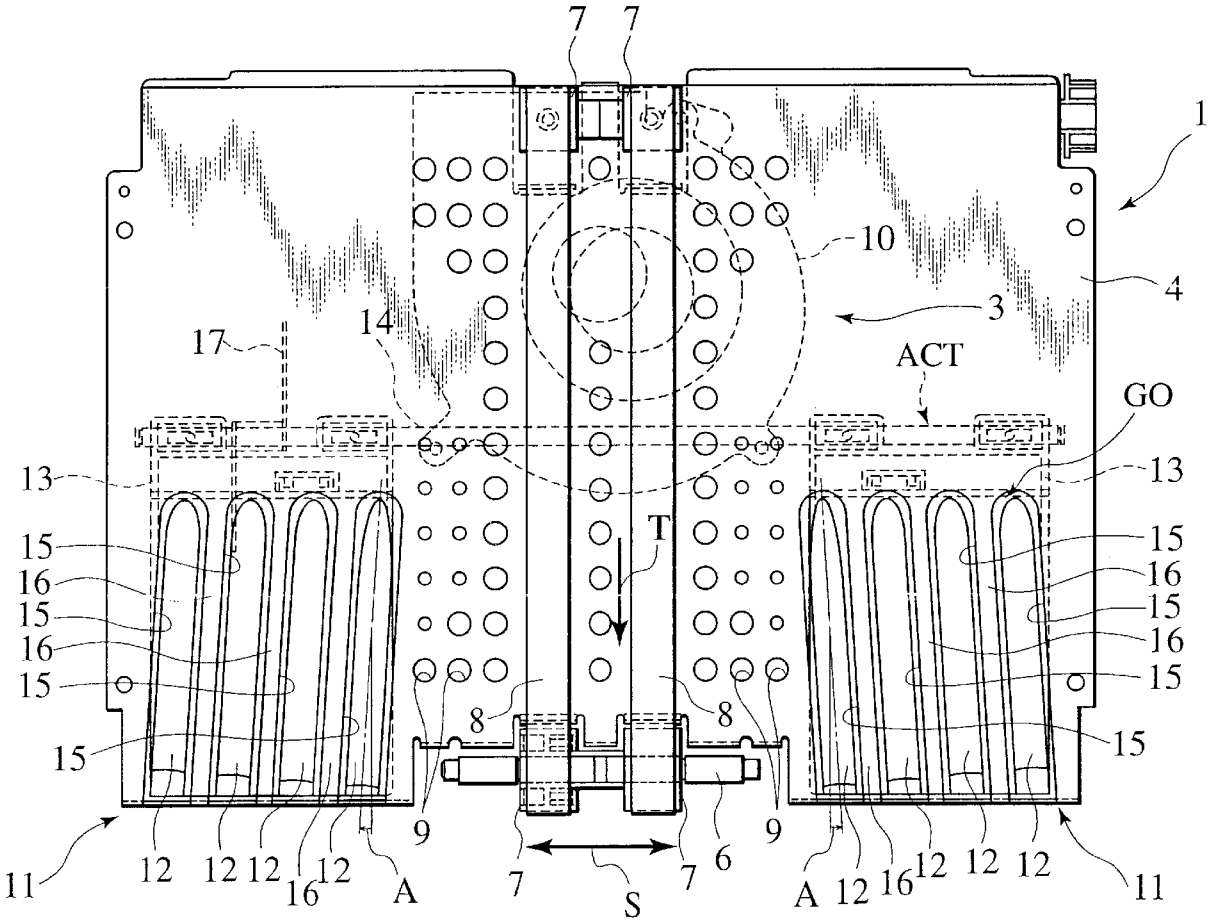
FIG. 2 is a plan view of the preferred embodiment of the sheet discharge unit shown in FIG. 1.
Figure 3:
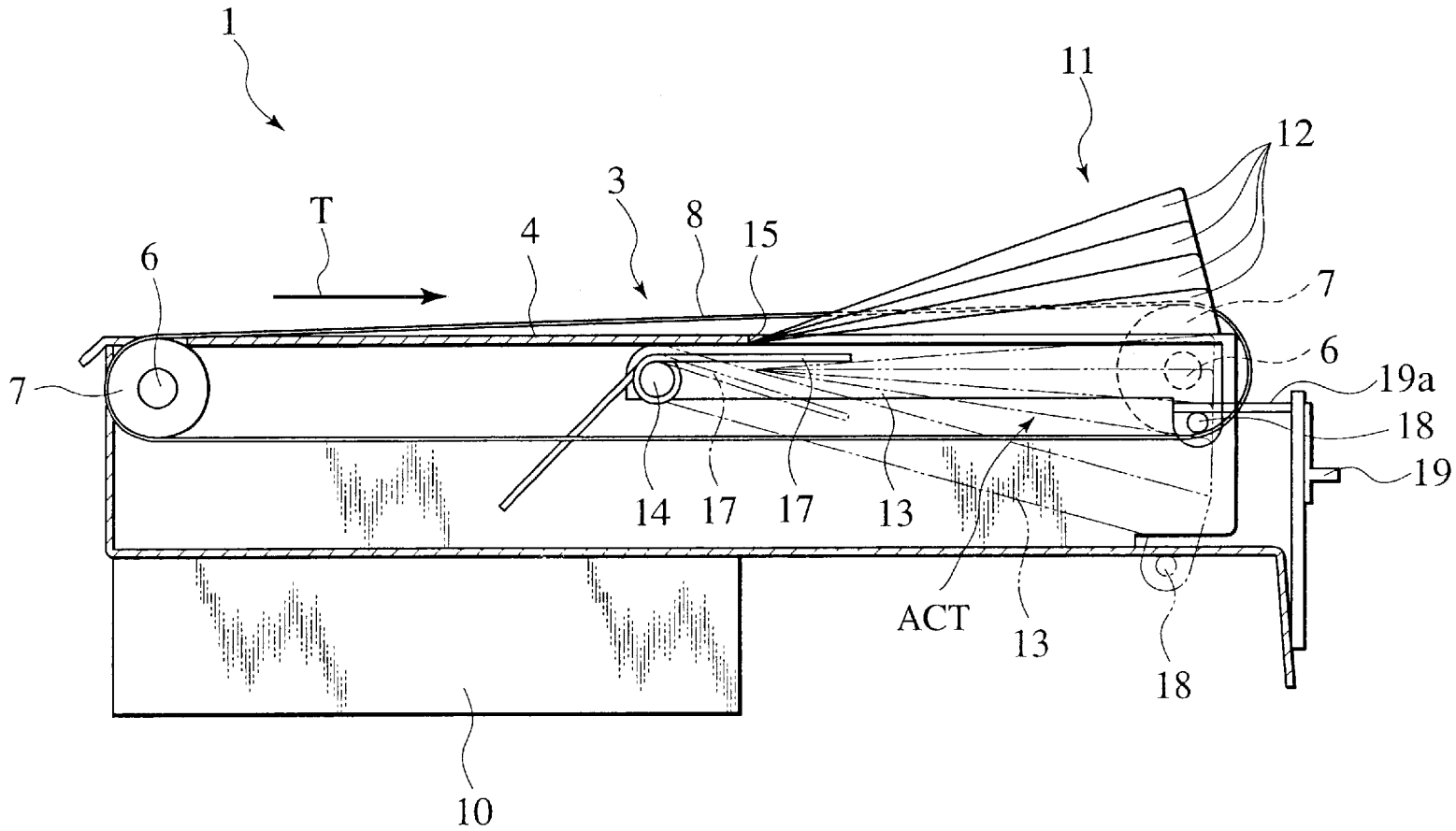
FIG. 3 is a cross sectional view of the sheet discharge unit as viewed from its one side.
Figure 4:
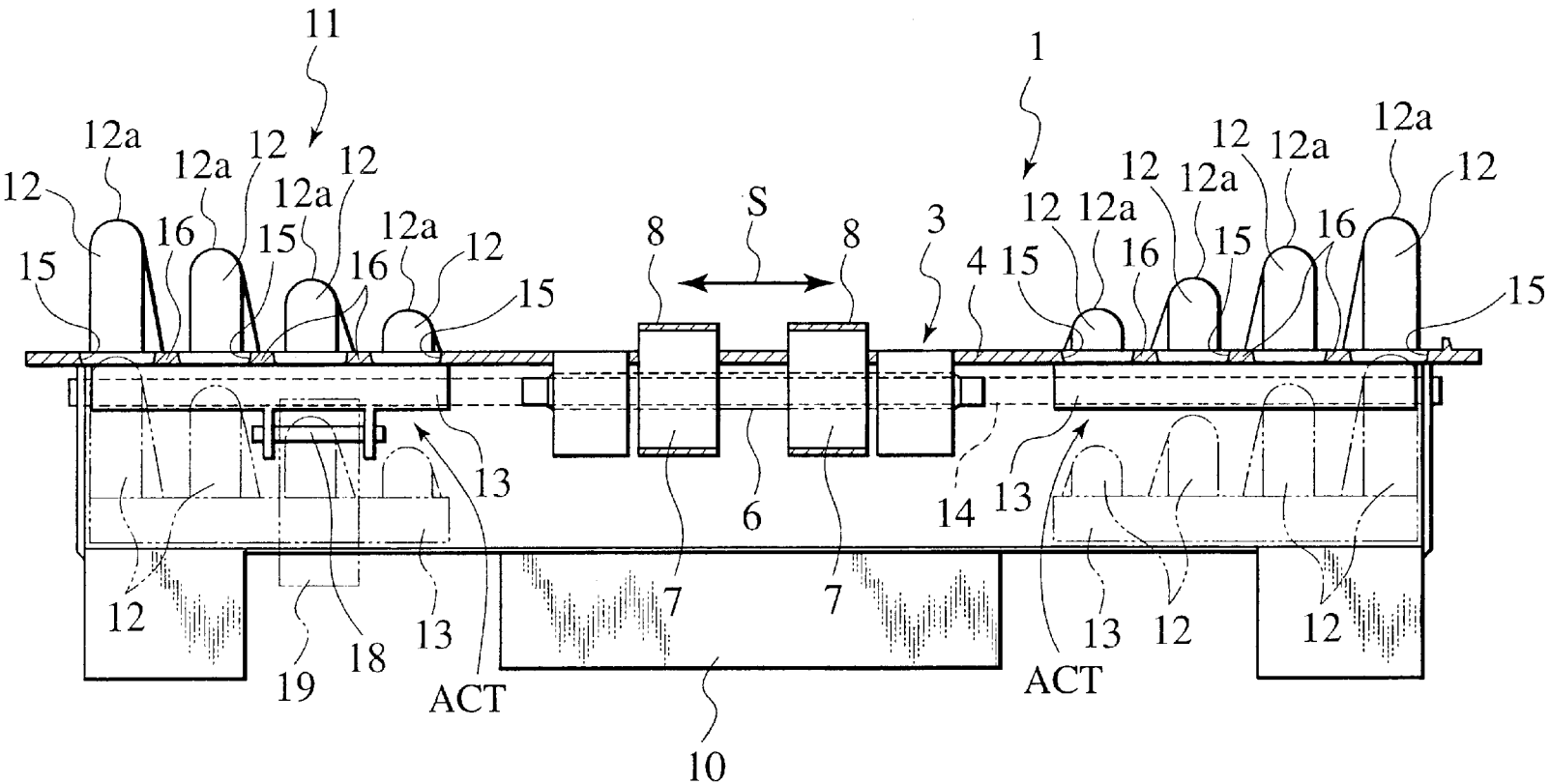
FIG. 4 is a cross sectional view of another part of the sheet discharge unit as viewed from its front side.

A description will be in detail given below of a sheet discharge unit in accordance with each of embodiments of the present invention preferably with reference to FIGS. 1 to 14.

Referring now to FIGS. 1 to 4, there is shown a first preferred embodiment of a sheet discharge unit according to the present invention which is shown as applied to a sheet discharge section of a printing machine SS.

In FIGS. 1 to 4, the sheet discharge unit 1 has a transfer passage 3 formed in a traveling path of a printed sheet 2. The transfer passage 3 is formed on a bottom plate 4 that is located in a lower area of the transfer passage 3, and side plates 5 located at both sides of the bottom plate 4. The bottom plate 4 has a transfer starting position and a transfer terminating position in which first and second laterally extending shafts 6 are supported in parallel to one another, respectively, with each shaft 6 carrying a pair of pulleys for rotating movement therewith. Two rows of endless belts 8, 8 extend in parallel to one another between the pulleys 7, 7, respectively, that are located in the transfer starting position and the transfer terminating position, respectively. The two rows of the endless transfer belts 8, 8 are located in a central zone of the transfer passage 3. Each of the transfer belts 8, 8 is caused to travel between the transfer starting position and the transfer terminating position along the transfer passage 3 by a driving force of a drive source (not shown). Also, the bottom plate 4 has a large number of suction holes 9, and a suction fan 10 is mounted beneath the bottom plate 4. With air above the transfer passage 3 being drawn by the suction fan 10, the printed sheet 2 is urged toward the transfer belts 8, 8. A pair of left and right sheet discharge wings 11, 11 are located in the transfer terminating position of the transfer passage 3 at both sides of the transfer belts 7, 7.

Each of jump wing pairs 11 includes a plurality of laterally spaced, divided wing components 12 (with four wing components being shown in the illustrated embodiment). A lower end of each wing component 12 is fixed to each wing base member 13, which is a part of an actuating member ACT, at a position beneath the bottom plate 4, with left and right wing base members 13 being firmly fixed to a laterally extending wing support shaft 14 and serving as another part of the actuating member ACT. The wing support shaft 14 is not supported by the side plates 5, and the left and right plural divided wing components 12, 12 are supported by the wing support shaft 14 such that the wing components 12, 12 are freely moveable between a guide position (indicated by a solid line in FIGS. 3 and 4) in which the wing components 12, 12 project upward from the bottom plate 4 as shown by a solid line in FIGS. 3 and 4 and a waiting position in which the wing components 12, 12 are located in a retracted position as shown by a phantom line in FIGS. 3 and 4. The bottom plate 4 has a pair of guide openings GO each composed of a plurality of laterally spaced elongated slots 15, 15 to allow the wing components 12, 12 to move between the protruding and retracted positions, with a plurality of shielding portions 16 each extending from the bottom plate 4 toward a position between adjacent elongated slots 15 to shield a spacing between the adjacent wing components 12, 12. That is, each of the slots 15 is formed in the bottom plate 4 in size to have a value sufficient for allowing the protruding and retracting movement of each wing component.

A coil spring 17, that forms another part of the actuating member ACT, is mounted on the wing support shaft 14 such that all of the divided wing components 12, 12 are urged toward the guide position. Also, one end of each of the left and right wing base members 13 has an engaging pin 18 fixed thereto, with the engaging pin 18 being held in engagement with a rod portion 19*a* of an actuating lever 19. With such a structure, the divided wing components 12, 12 are moved in varying positions between the guide position and the waiting position due to upward and downward movement of the actuating lever 19. The guide position may be defined with and selected from those positions in which all the divided wing components 12, 12 protrude upward from the bottom plate 4 or in which only parts of the wing components protrude upward. Due to this arrangement, it is possible to have the divided wing components 12, 12 to enable the printed sheet 2 of different sizes to be deformed in suitably curved profiles, respectively.

All the divided wing components 12, 12 have heights that gradually increase toward a downstream side of a sheet discharge direction T and have extreme highest distal ends sharply standing downright. As viewed in FIGS. 1 and 4, the divided wing components 12 of each set have heights that gradually increase from an inside toward an outside such that both sides of the printed sheet 2 have those curved portions which upwardly increase in heights toward right and left distal ends. As viewed in FIG. 2, each set of the right and left divided wing components 12 are arranged such that each wing component 12 extends in a direction inclined at an angle A (for example, about three degrees) with respect to the transfer direction T of the printed sheet 2. More particularly, the right and left divided wing components 12, 12 are arranged to expand in outer directions toward the downstream side of the sheet discharge direction T. Also, each of the divided wing components 12 has an upwardly facing, substantially arch shaped curved surface 12*a*.

As shown in FIG. 1, a paper receiving tray 20 is located in an area, which lies on the sheet discharging direction, at the side of a paper discharging downstream of and at a lower portion of the transfer terminating position of the transfer passage 3. The paper receiving tray 20 has both sides mounted with side fences 21 and has a distal end, at the side of paper discharging downstream, mounted with an upright end fence (not shown).

In operation, when a printed sheet 2 is conducted to the transfer starting position of the transfer passage 3, the printed sheet 2 is sucked with air drawn by the suck fan 10 toward the bottom wall of the transfer passage 3 and is urged toward the transfer belts 8, 8. The printed sheet 2 that is urged toward the transfer belts 8, 8 is then transferred to the transfer terminating position. Here, in the event that the printed sheet 2 to be discharged has a small rigidity, the pair of sheet discharge wings 11, 11 each composed of the divided wing components 12 are held in the guide positions as shown by solid lines in FIGS. 3 and 4. When this occurs, the both ends of the printed sheet 2 are upwardly guided by the left and right divided wing components 12, 12 such that the printed sheet 2 is discharged with its both ends curved upward from a central portion. In this instance, the printed sheet 2 has an increased apparent rigidity and is caused to drop on the paper receiving tray 20 along a stable dropping trajectory. In the event that the printed sheet 2 has a strong rigidity, the left and right divided wing components 12, 12 are kept in their waiting positions. In this instance, the printed sheet 2 is smoothly discharged in a stable dropping state owing to its inherent property of strong rigidity.

During the course of the paper discharging step, when the plural divided wing components 12 are held in the guide position, the printed sheet 2 passing through the transfer passage 3 are guided by the plural divided wing components 12 located in the left and right positions. Since, in this instance, the plural divided wing components 12 are laterally spaced from one another, the printed sheet 2 is brought into contact with the plural divided wing components 12 in a minimum contact area even in a case where the left and right sheet discharging wings 11, 11 are formed in width that corresponds to various sizes of the printed sheet 2 and, therefore, the sheet discharging wings 11 cover or cope with printed sheets of various sizes, with a resultant decrease in running resistance of the printed sheet 2 and the amount of paper dust or paper powder produced thereby.

In the first preferred embodiment discussed above, when the plural divided wing components 12 are held in the wait position, although the bottom plate 4, that serves as a bottom wall of the transfer passage 3, has a plurality of elongated slots 15 to accommodate therein the corresponding wing components 12, since the space between the adjacent slots 15 is sealed with the shielding portion 16 and there is no large openings left in the vicinity of the wing components 12, the printed sheet 2 is smoothly transferred without being undesirably caught by the elongated slots 15 in the transfer passage 3, thereby preventing the printed sheet 2 from being undesirably displaced from the paper discharging path.

Figure 5A:
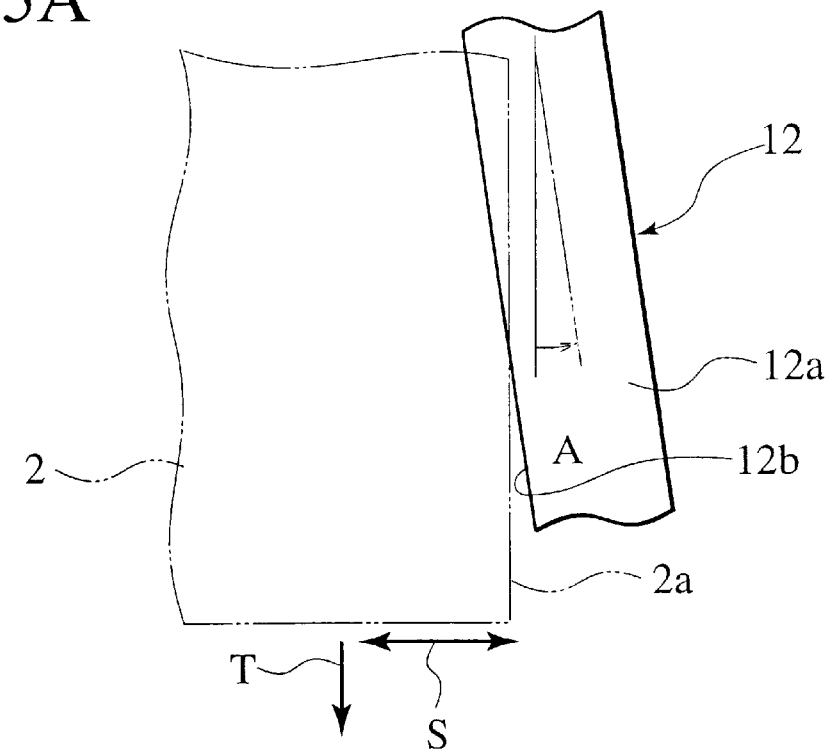
FIG. 5A is an enlarged, partial plan view showing a contact condition between divided wing components that are inclined in a sheet discharge direction, and a terminal end of a printed sheet.
Figure 5B:
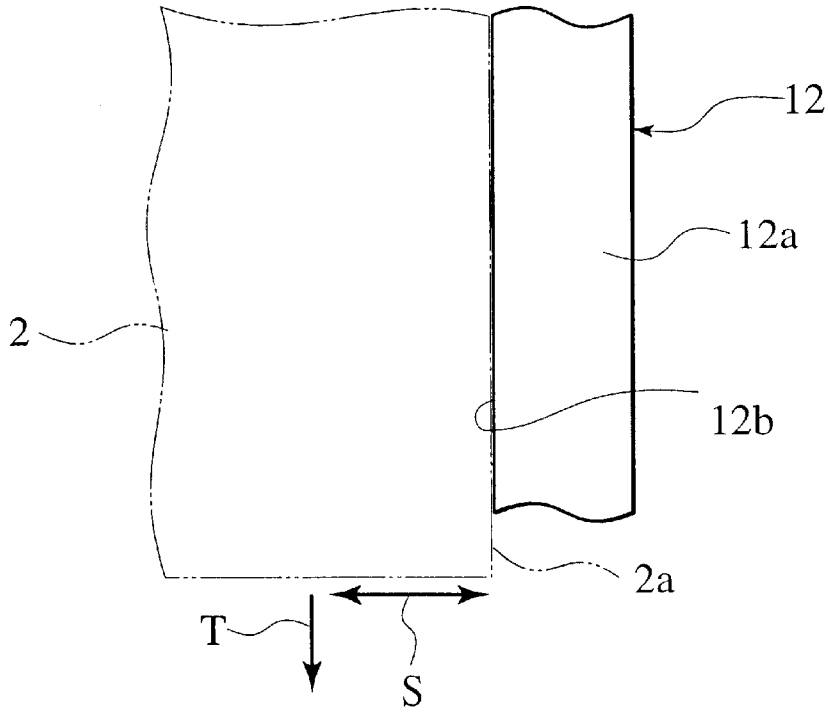
FIG. 5B is an enlarged, partial plan view showing the contact condition between the divided wing components that extends in the same direction as the sheet discharge direction, and the terminal end of the printed sheet.

As shown in FIG. 5A, in the first preferred embodiment, since the transfer direction T of the printed sheet 2 and the direction of each divided wing component 12 in which it extends is different from one another, the printed sheet 2 is transferred under a state in which a side edge 2*a* of the printed sheet 2 is prevented from contacting a side wall 12*b* of the divided wing component 12, it is possible to prevent undesirable wear of the divided wing component 12 and undesirable displacement of the printed sheet 2 from its normal transfer trajectory. That is, as shown in FIG. 5B, if the transfer direction T of the printed sheet 2 and the direction of the divided wing component 12 in which it extends are identical, although the printed sheet 2 tends to be transferred with the side edge 2*a* held in contact with the side wall 12*b* of the divided wing component 12 with resultant wear of the side wall 12*b* of the divided wing component 12 and the printed sheet 2 is caused to be displaced in directions offset from the normal transfer direction T due to wear of the divided wing component 12, it is possible to overcome these phenomena with the first preferred embodiment.

Figure 6A:
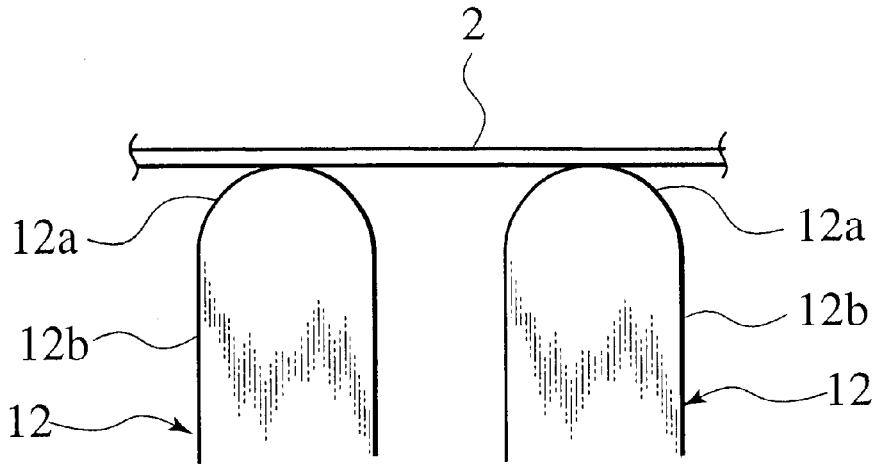
FIG. 6A is a view illustrating the contact condition between the divided wing components and a lower end of the printed sheet wherein the divided wing components have respective, upper arch shaped curved profiles.
Figure 6B:
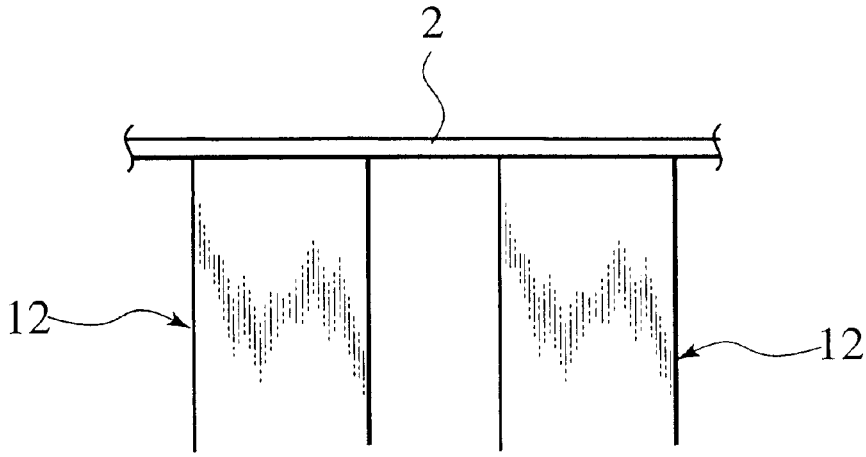
FIG. 6B is a view illustrating the contact condition between the divided wing components and the lower end of the printed sheet wherein the divided wing components have respective upper flat surfaces.

In the first preferred embodiment, since each of the divided wing components 12 is designed to have an upper wall formed with an arch shaped curved surface 12*a*, the printed sheet 2 is softly brought into contact with the curved surface 12*a* of the divided wing component 12 and the contact surface area of the printed sheet 2 relative to the divided wing component 12 becomes minimum as shown in FIG. 6A, with a resultant decrease in the running resistance of the printed sheet 2 and the amount of paper dust or powder that would be produced from the printed sheet 2. That is, as shown in FIG. 6B, if the divided wing components 12 have upper ends formed with flat surfaces 12*c*, 12*c*, respectively, the printed sheet 2 is brought into contact with the flat surfaces 12*c*, 12*c* of the divided wing components 12 without soft touch and the contact area increases, with a resultant increase in the running resistance of the printed sheet 2 and the amount of paper powder that would be produced by the printed sheet 2 owing to the increased running resistance of the printed sheet 2. In contrast, the first preferred embodiment makes it possible to overcome these phenomena.

Figure 7:
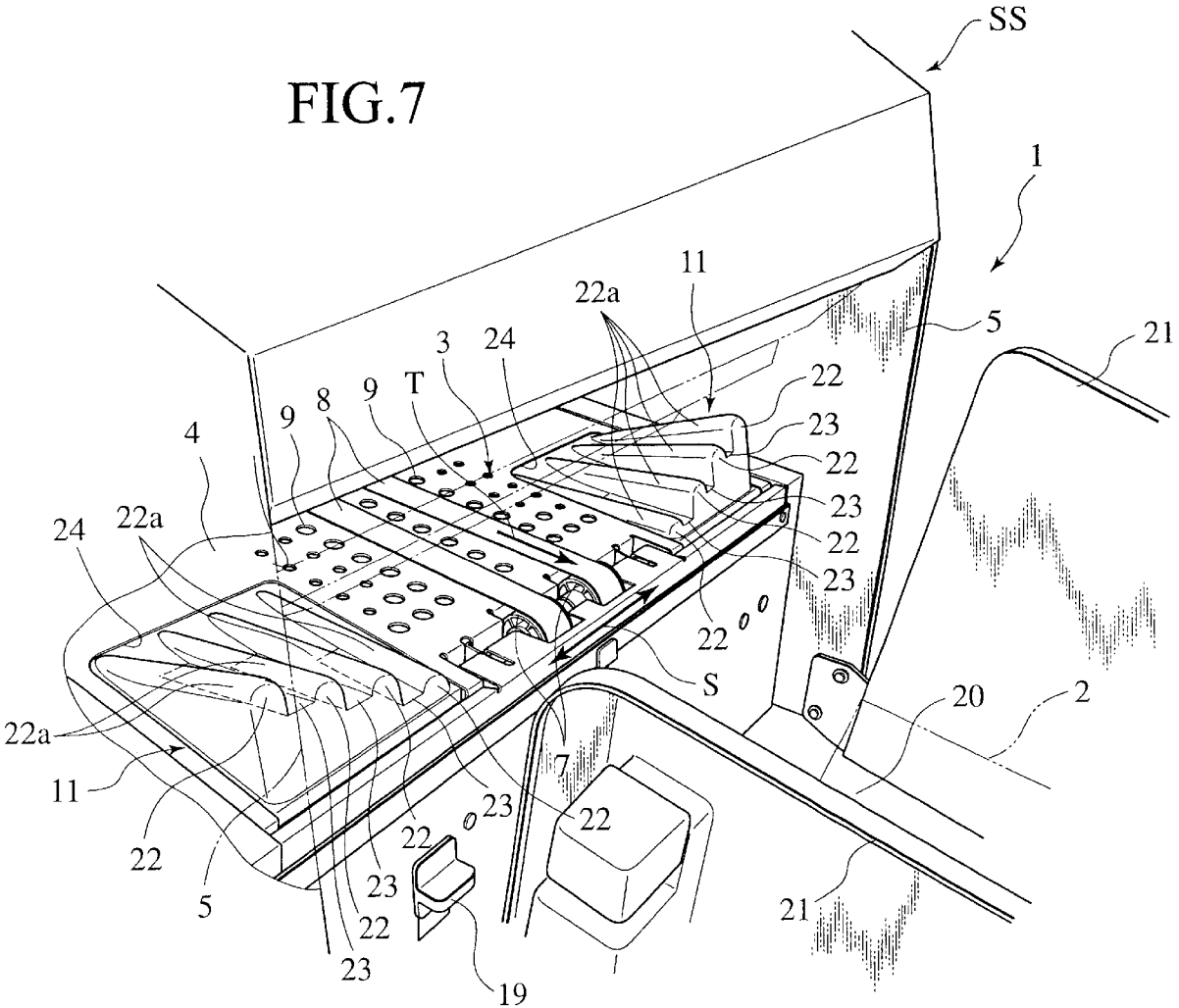
FIG. 7 is an exploded perspective view of a second preferred embodiment of a sheet discharge unit according to the present invention, with the sheet discharge unit being shown as applied to a sheet discharge section of a printing machine.
Figure 8:
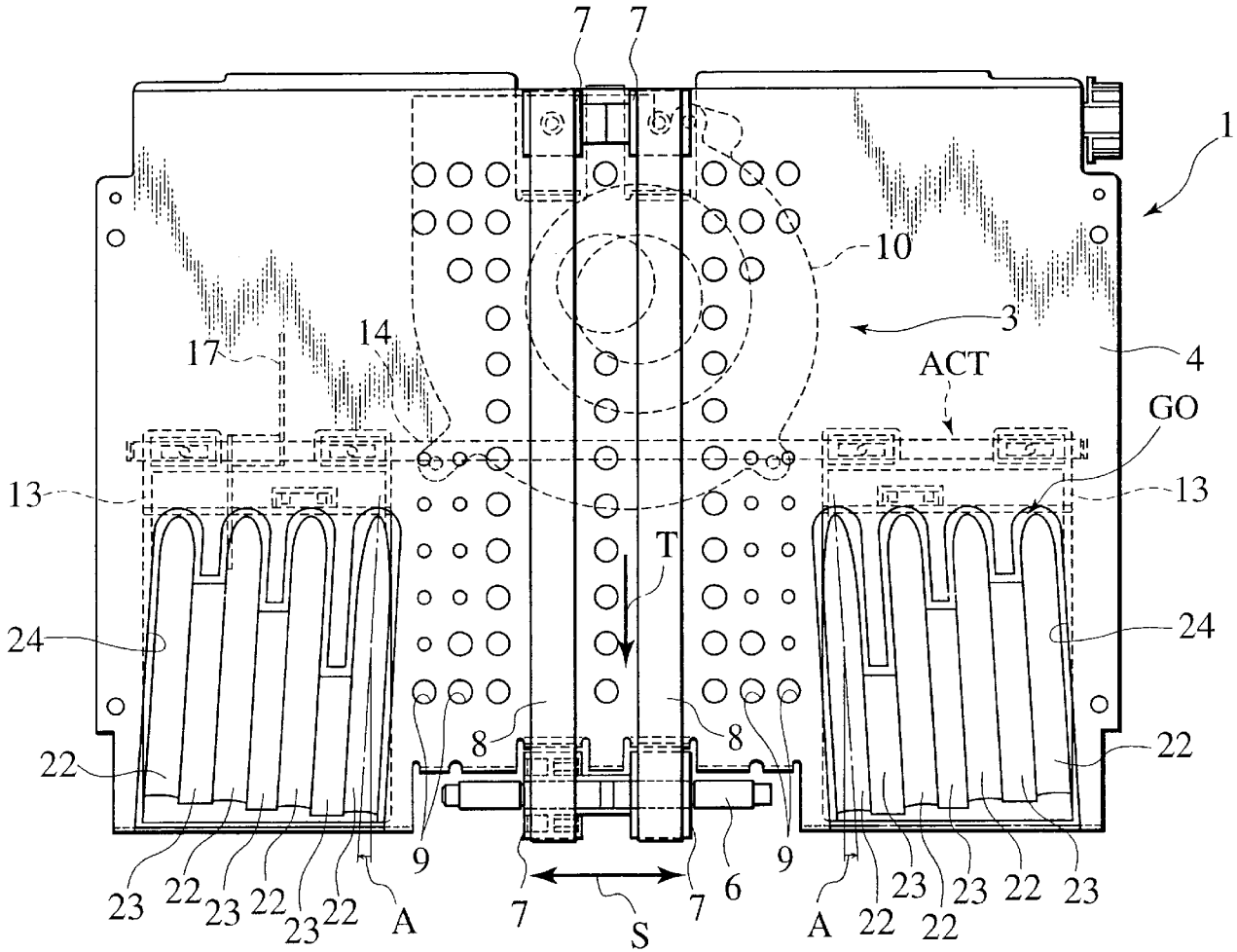
FIG. 8 is a plan view of the sheet discharge unit shown in FIG. 7.
Figure 9:
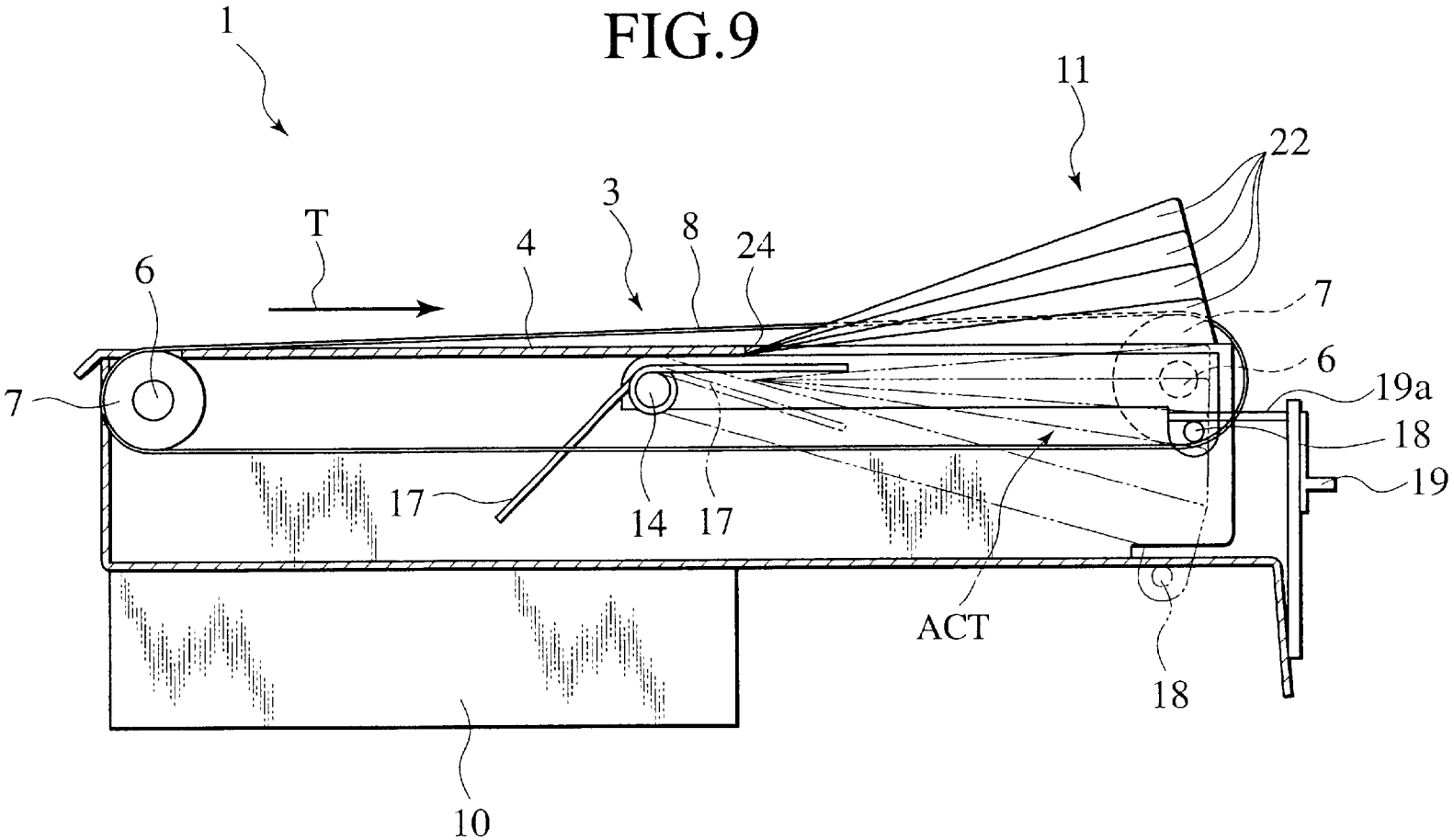
FIG. 9 is a cross sectional view of the sheet discharge unit of FIG. 7 as viewed from a side of the unit.
Figure 10:
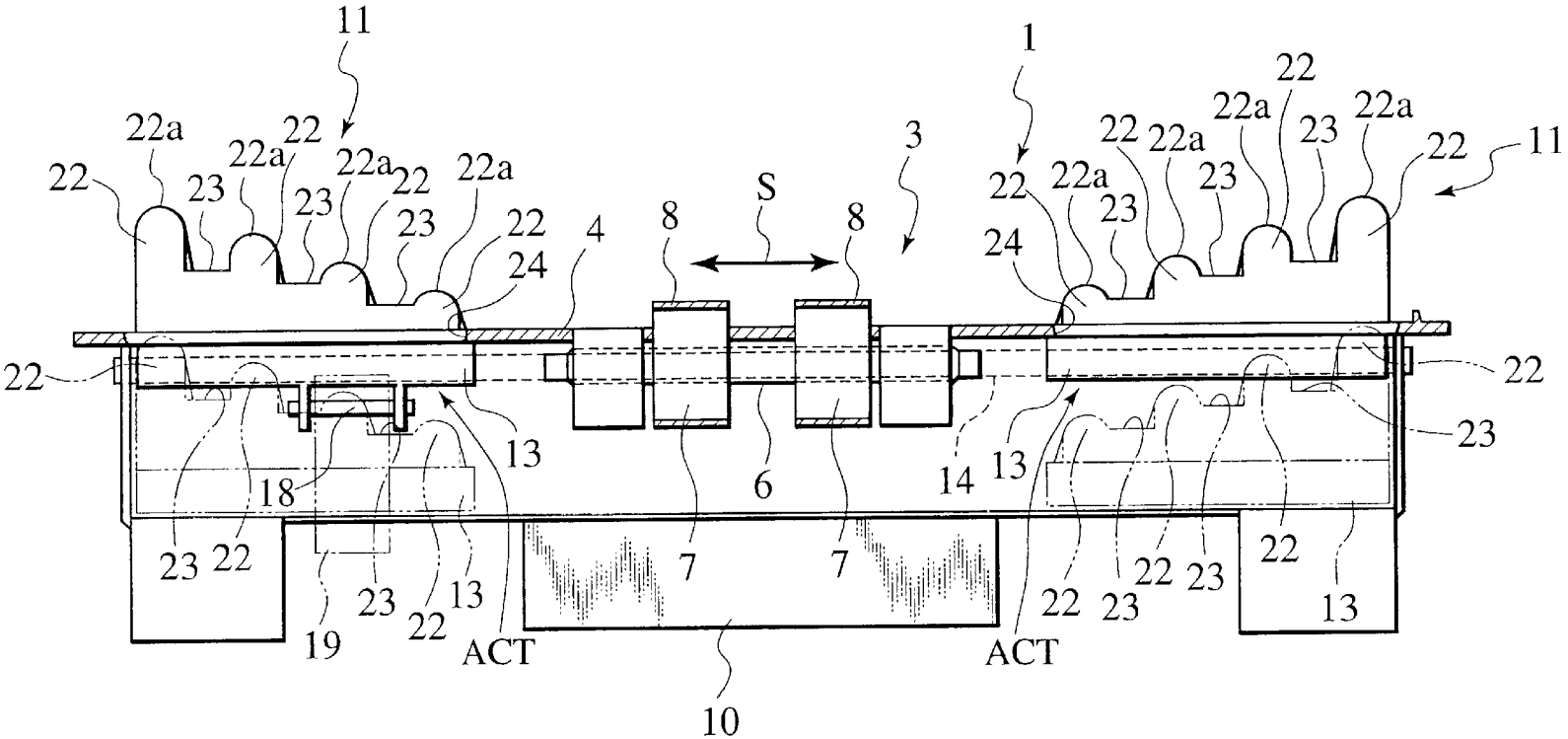
FIG. 10 is a cross sectional view of the sheet discharge unit of FIG. 7 as viewed from a front side.

A second preferred embodiment of a sheet discharge unit according to the present invention is illustrated in FIGS. 7 to 10, wherein FIG. 7 is an exploded view of a sheet discharging unit mounted in a sheet discharging section of a printing machine, FIG. 8 is a plan view of the sheet discharging unit, FIG. 9 is a sectional view as viewed from a side portion of the sheet discharging unit and FIG. 10 is a cross sectional view as viewed from a front portion of the sheet discharging unit.

The second preferred embodiment shown in FIGS. 7 to 10 is identical to the first preferred embodiment except the pair of jump wings. Therefore, like parts bear the same reference numerals as those used in FIGS. 1 to 4 and a detailed description will be given only to the pair of jump wings.

Particularly, each of left and right jump wings 11, 11 is not a divided type but comprises a unitary type that includes laterally spaced convex segments 22, with which the printed sheet 2 is brought into contact, and laterally spaced concave segments or recesses 23, with which the printed sheet 2 is not brought into contact, with the convex segments 22 and the concave segments 23 being alternately formed in a direction S substantially perpendicular to the sheet discharging direction T. The bottom plate 4, which serves as a bottom wall of the transfer passage 3, has a pair of relatively large guide openings 24, 24 to allow protruding or retracting motions of the left and right jump wings 11, 11, respectively.

Further, each of the convex segments 22 has heights that gradually increase toward a downstream side of the sheet discharging direction T and have extreme highest distal ends sharply standing downright. Also, each of the convex segments 22 of the left and right sheet discharging wings 11, 11 has heights that gradually increase from an inside toward an outside such that both sides of the printed sheet 2 have those curved portions which upwardly increase in heights toward right and left distal ends. In addition, each of the convex segments 22 of the left and right jump wings 11, 11 extends in a direction inclined at an angle A (for example, about three degrees) with respect to the sheet discharging direction T of the printed sheet 2. More particularly, the convex segments 22 of the left and right jump wings 11, 11 are arranged to expand in outer directions toward the downstream side of the sheet discharging direction T. Also, each of the convex segments 22 has an upwardly facing, substantially arch shaped curved surface 22*a*.

In the second preferred embodiment discussed above, when the left and right jump wings 11, 11 are held in the guide position, although the printed sheet 2 passing through the transfer passage 3 is guided by each convex segments 22 of the left and right jump wings 11, 11. Since, in this instance, the convex segments 22 are laterally spaced from one another, the printed sheet 2 is brought into contact with the convex segments 22 in a minimum contact area even in a case where the left and right jump wings 11, 11 are formed in width that corresponds to various sizes of the printed sheet 2 and, therefore, the jump wings 11 cover or cope with printed sheets of various sizes, with a resultant decrease in running resistance of the printed sheet 2 and the amount of paper dust or powder produced thereby.

In the second preferred embodiment, since the transfer direction T of the printed sheet 2 and the direction of each convex segments 22 in which it extends is different from one another, the printed sheet 2 is transferred under a state in which a side edge 2*a* of the printed sheet 2 is prevented from contacting a side wall of the convex segment 22, it is possible to prevent undesirable wear of the convex segments 22 of the jump wings 11, 11 and undesirable displacement of the printed sheet 2 from its normal transfer trajectory.

In the second preferred embodiment, since each of the convex segments 22 is designed to have an upper wall formed with an arch shaped curved surface 22*a*, the printed sheet 2 is softly brought into contact with the curved surface 22*a* of the convex segments 22 and the contact area of the printed sheet 2 relative to the convex segments 22 becomes minimum, resulting in a decrease in the running resistance of the printed sheet 2 and amount of paper dust or powder that would be produced from the printed sheet 2.

Namely, the second preferred embodiment substantially has the same functions and advantages as those of the first preferred embodiment discussed above. However, in the second preferred embodiment, an additional structure for preventing the printed sheet 2 from being caught by the openings 24, 24 is not specifically provided.

Figure 11:
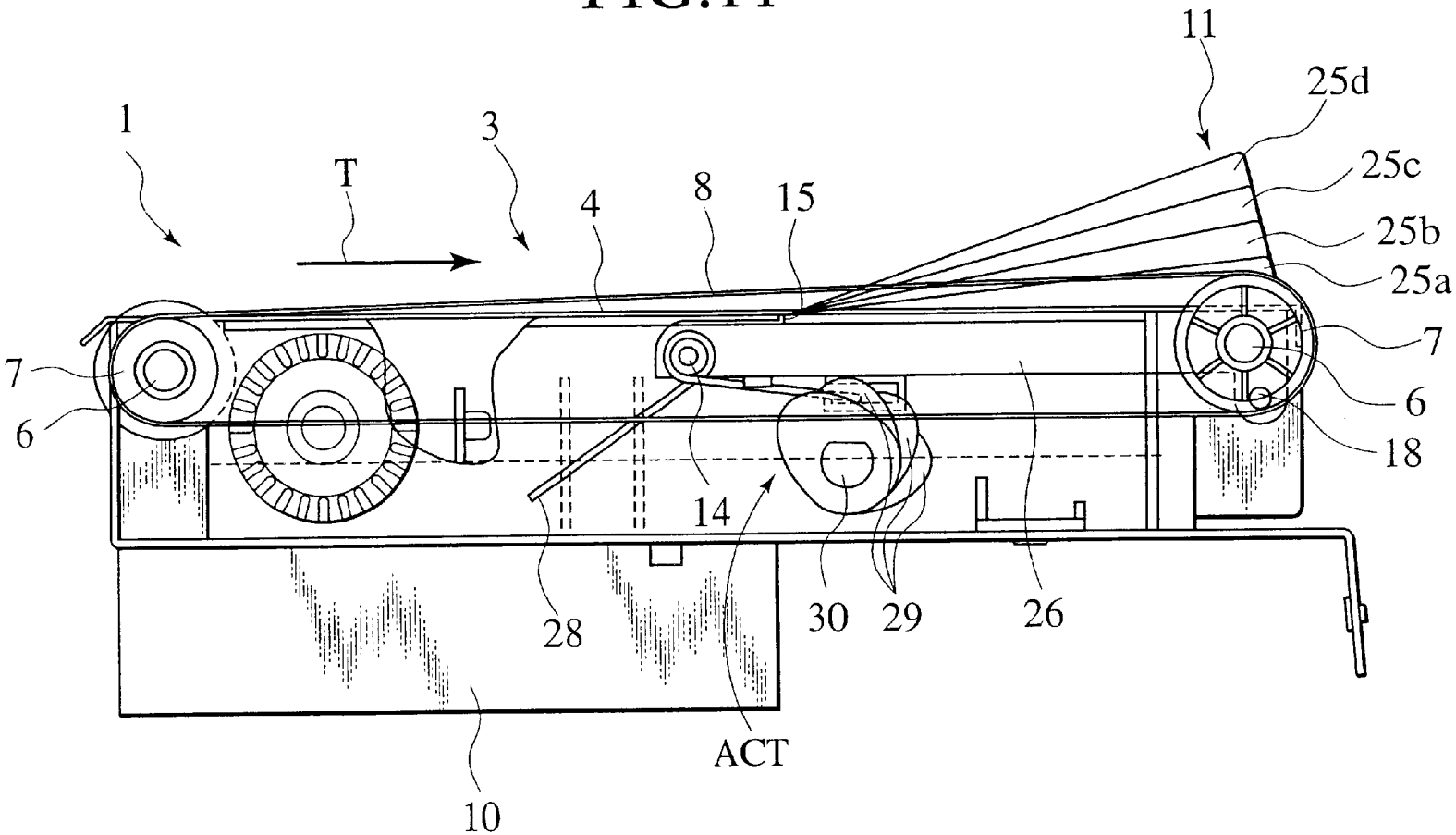
FIG. 11 is a side view of a third preferred embodiment of a sheet discharge unit according to the present invention, with the sheet discharging unit being applied to the sheet discharge section of the printing machine.
Figure 12:
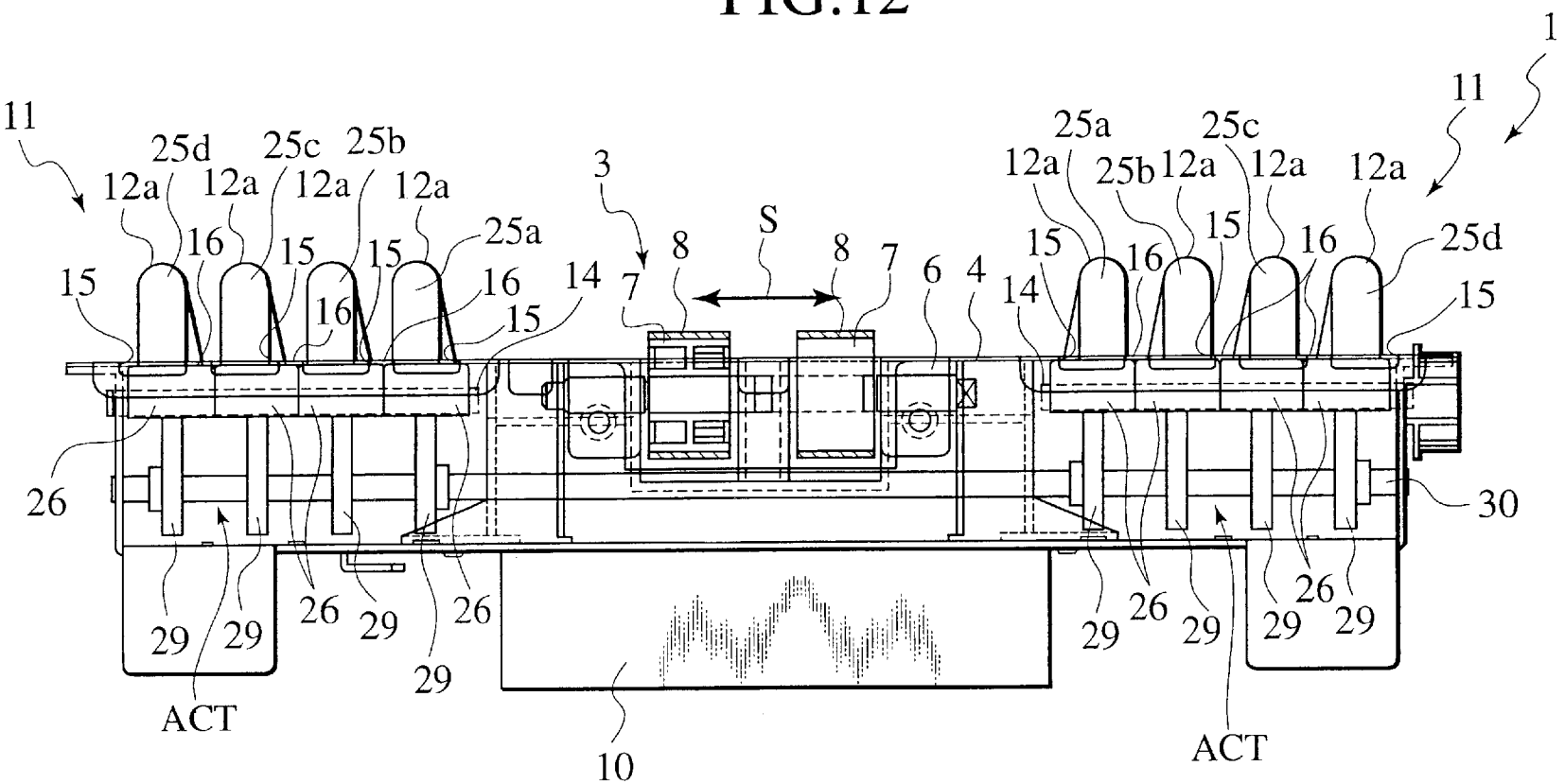
FIG. 12 is a front view of the sheet discharge unit shown in FIG. 11.
Figure 13A:
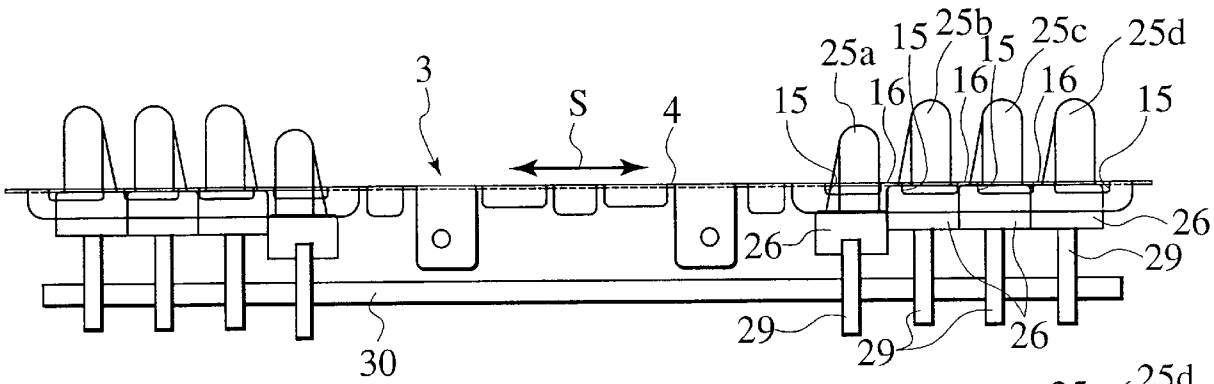
FIGS. 13A to 13C show various guide patterns of divided wing components, respectively, of the sheet discharge unit of FIG. 11.
Figure 13B:
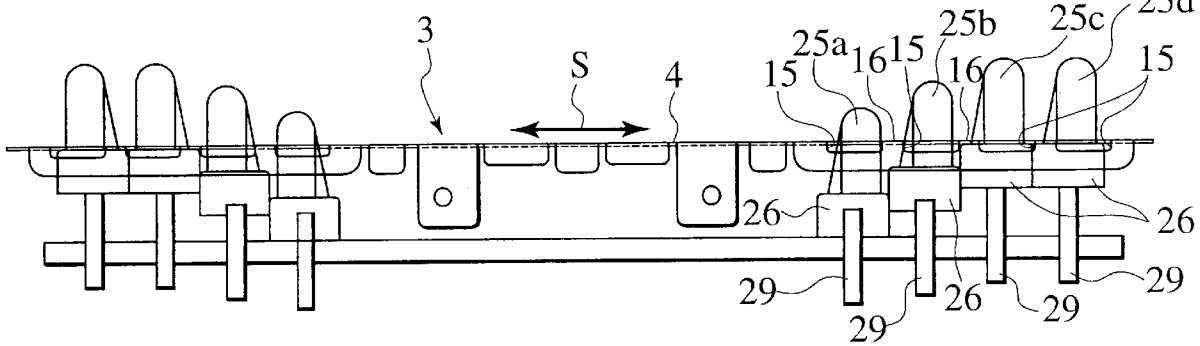
Figure 13C:
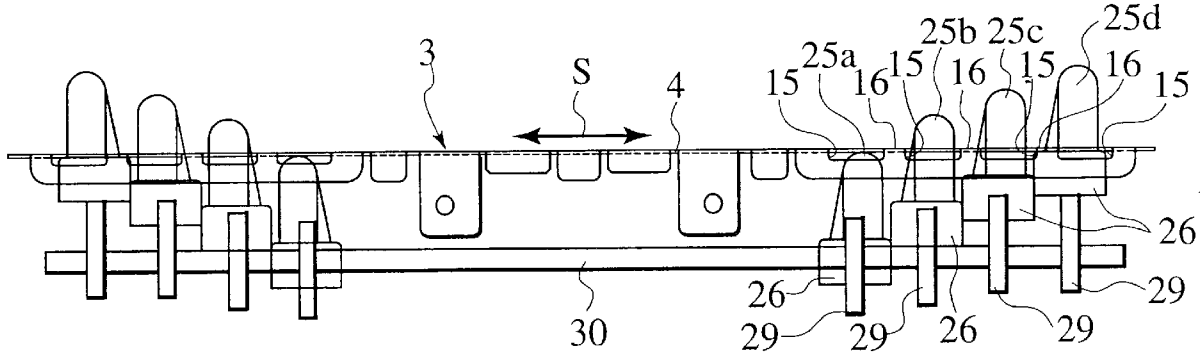
Figure 14A:
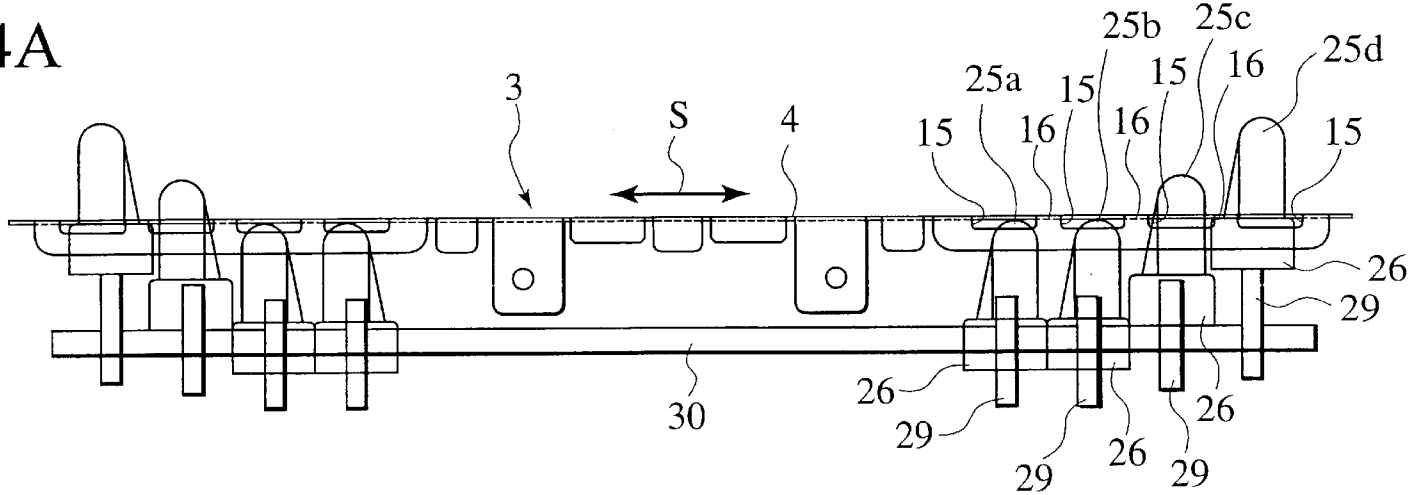
FIGS. 14A and 14B show the other guide patterns of the divided wing components, respectively, of the sheet discharge unit of FIG. 11.
Figure 14B:
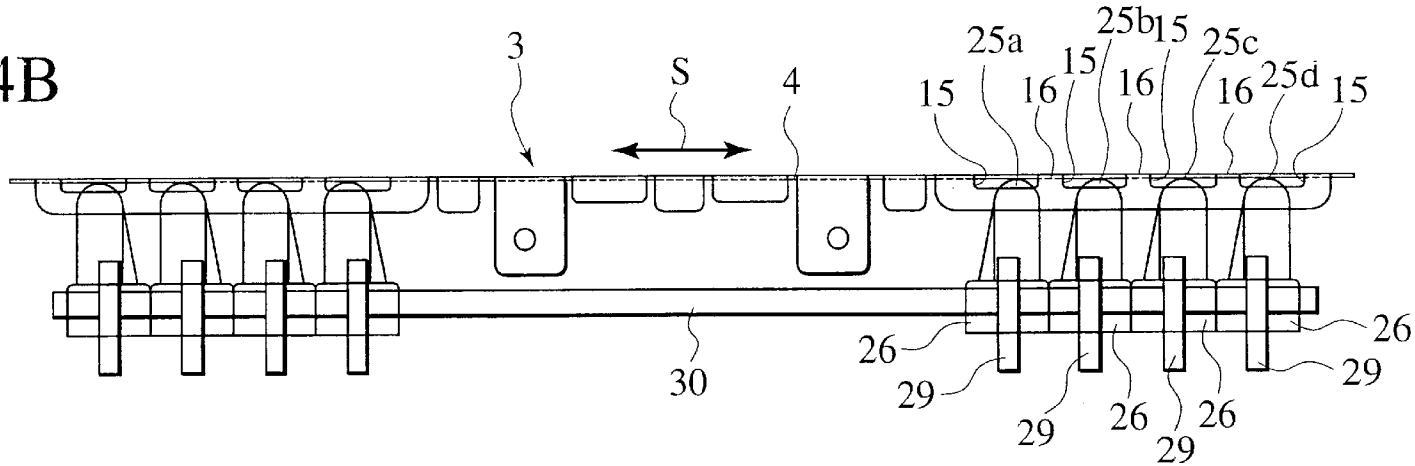
Figure 15:
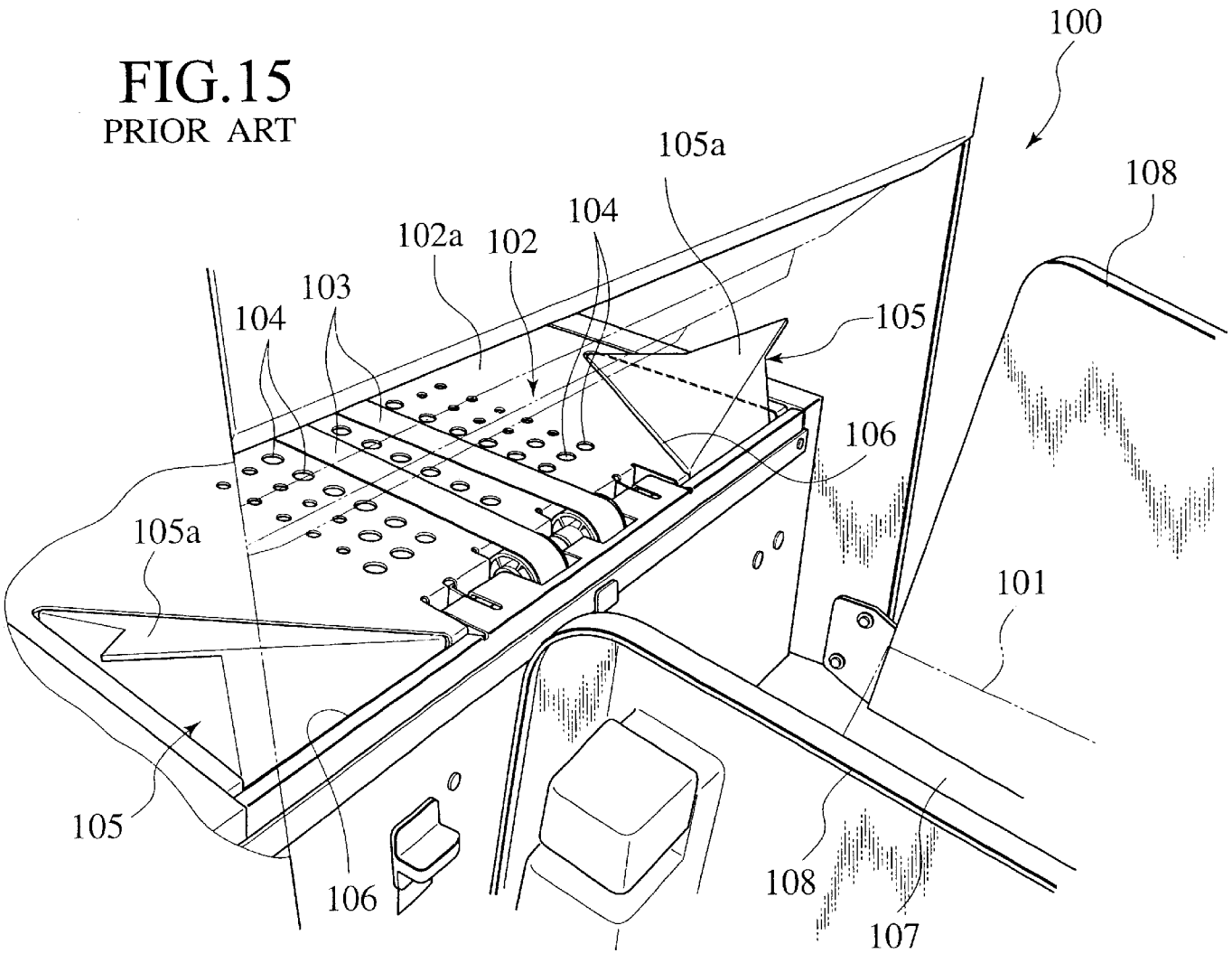
FIG.15 PRIOR ART
FIG. 15 is a perspective view of a conventional sheet discharge unit.

A third preferred embodiment of a sheet discharge unit according to the present invention is shown in FIGS. 11 to 14, wherein FIG. 11 is a side view of the sheet discharge unit, FIG. 12 is a front view of the sheet discharge unit, FIGS. 13A, 13B and 13C and FIGS. 14A and 14B show various guide modes of respective divided wing components.

In the third preferred embodiment of FIGS. 11 to 14, like parts bear the like reference numerals as those used in FIGS. 1 to 4 which illustrate the first preferred embodiment, and description of these like parts are omitted for the sake of simplicity and only essential structural part of the third preferred embodiment will be described. Each of the left and right jump wings 11 includes a plurality of divided wing components 25*a* to 25*d* like in the first preferred embodiment, and the divided wing components 25*a* to 25*d* are not fixed to the common base member but are fixed to individual wing base members 26 that form a part of the actuating member ACT. In addition, one end of each of the wing base members 26 is not fixed to the wing support shaft 14, but is supported on the wing support shaft 14 for free rotation thereabout such that rotation of each of the divided wing components 25*a* to 25*b* about the wing support shaft 14 enables the individual divided wing components to move between the guide position and the wait position independently from one another. A plurality of twisted coil springs 28 are connected to the individual wing base members 26, respectively, and, thus, each of the divided wing components 25*a* to 25*d* is urged toward the waiting position.

As shown in FIGS. 11 and 12, the sheet discharge unit also includes a cam shaft 30, laterally extending at a position beneath the divided wing components 25*a* to 25*d*, that carries a plurality of cam members 29 fixed to the cam shaft 30 at locations corresponding to the individual wing base members 26, respectively. The cam members 29 and the cam shaft 30 form another part of the actuating member ACT. With such a structure, the wing base members 26 are urged toward the respective cam members 29 by the actions of the coil springs 28. As a result, the wing base members 26 are caused to rotate around the cam shaft 30 while following the cum surfaces of the cam members 29, respectively, to shift between the guide position and the waiting position. The plural cam members 29 have cam lobes which are shifted in angular position from one another and rotate the left and right divided wing components 25*a* to 25*d* such that they can be shifted to various guide modes composed of the highest guide position and a lower guide position shown in FIGS. 13A, 13B and 13C, and a wait position shown in FIGS. 14A and 14B.

The third preferred embodiment substantially has the same functions and advantages as those of the first preferred embodiment discussed above. Further, since the divided wing components 25*a* to 25*d* are individually and independently moveable from one another in the third preferred embodiment, the divided wing components 25*a* to 25*d* are moveable to various guide modes. Consequently, it is possible for the printed sheet 2 to be curved in a suitable profile depending on the size or the rigidity of the printed sheet 2 and, therefore, it is possible to discharge the printed sheet 2 of various kinds in a stable manner.

In the preferred embodiments discussed above, although the left and right divided wing components 12 and 25*a* to 25*d* and the convex segments 22 of the left and right jump wings 11, 11 are inclined gradually outward toward the sheet discharge direction T, the wing components and the convex segments may be inclined gradually inward to have the similar function and advantages.

In the preferred embodiments discussed above, although the sheet discharge unit 1 has been shown and described as applied to the sheet discharge section of the printing machine, the sheet discharge unit of the invention may also be applied to the sheet discharge section of an apparatus (a copying machine) wherein a sheet of paper is treated and discharged.

According to one advantage of the present invention, when the plural divided wing components remain in the guide position, a sheet of paper passing through the transfer passage is guided by the respective divided wing components located in the left and right positions. Since, in this instance, the divided wing components are separately located from one another, the contact area between the sheet of paper and all of the divided wing components becomes minimum even in a case wherein the divided wing components are located in width corresponding to various sizes of the sheet of papers, the sheet discharge unit may cover or cope with the sheet of papers of various sizes, resulting in a decrease in the running resistance of the sheet of paper and the amount of paper dust or powder that would be produced from the sheet of paper.

According to another advantage of the present invention, when the left and right jump wings are held in the guide position, although the printed sheet passing through the transfer passage is guided by each of the left and right sheet discharge wings, the printed sheet is brought into contact with the convex segments but is not brought into contact with the concave recesses, the contact area between the jump wings and the printed sheet becomes minimum even in a case where the sheet discharge wings are located in width corresponding to the various sizes of the printed sheet to cover or cope with the various sizes of the printed sheet, with a resultant decrease in the running resistance of the printed sheet and the amount of paper dust or paper powder that would be produced from the printed sheet.

According to another advantage of the present invention, when the plural divided wing components are held in the waiting position, although the bottom plate, that serves as a bottom wall of the transfer passage, has a plurality of elongated slots to accommodate therein the corresponding wing components, the space between the adjacent slots is sealed with the shielding portion and there is no large openings left in the vicinity of the wing components, the printed sheet is smoothly transferred without being undesirably caught by the elongated slots in the transfer passage, thereby preventing the printed sheet from being undesirably displaced from the paper discharging path.

According to another advantage of the present invention, since the transfer direction of the printed sheet and the direction of each divided wing component in which it extends is different from one another, the printed sheet is transferred under a state in which a side edge of the printed sheet is prevented from contacting a side wall of the divided wing component, it is possible to prevent undesirable wear of the divided wing component and undesirable displacement of the printed sheet from its normal transfer trajectory. According to another advantage of the present invention, since the transfer direction of the printed sheet is different from that of each convex segment of the jump wings in which it extends, the printed sheet can be transferred without the side edge being held in contact with the side wall of the convex segments and undesirable wear of the convex segments of the divided wing components is avoided and the printed sheet is caused to be displaced in directions offset from the normal transfer direction.

According to a further advantage of the present invention, since each of the divided wing component has an upper wall formed with an arch shaped curved surface, the printed sheet is softly brought into contact with the curved surface of the divided wing component and the contact area of the printed sheet relative to the divided wing component becomes minimum, with a resultant decrease in the running resistance of the printed sheet and the amount of paper dust or powder that would be produced from the printed sheet.

According to a further advantage of the present invention, since the printed sheet is brought into contact with the arch shaped curved surface of each convex segment of the jump wings and the contact area becomes minimum, with a resultant decrease in the running resistance of the printed sheet and the amount of paper dust or paper powder produced from the printed sheet.

According to a further advantage of the present invention, since the sheet discharge unit of the invention makes it possible to have the printed sheet to be curved in a suitable profile depending on the kinds, i.e., size or the rigidity of the printed sheet to be transferred, it is possible to discharge the printed sheet of various kinds in a stable manner.

According to a still further advantage of the present invention, the sheet discharge unit is applied to the sheet discharging section of the printing machine and various merits can be obtained in a manner as discussed above.

The entire content of a Patent Application No. TOKUGAN 2000-44898 with a filing date of Feb. 22, 2000 in Japan are hereby incorporated by reference.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A sheet discharge unit comprising:

a paper receiving tray;

a transfer passage for transferring a sheet of pre-treated paper to the paper receiving tray along a sheet transfer direction;

guide openings formed at both sides of the transfer passage;

a transfer member located in the transfer passage to impart a force to the sheet of pre-treated paper so as to move the sheet of pre-treated paper in the sheet transfer direction;

jump wings respectively disposed in the guide openings comprising a plurality of laterally spaced, substantially parallel convex portions each having a convex upper surface and each having a longitudinal upstream end and a longitudinal downstream end, the upstream and downstream ends being aligned substantially in the sheet transfer direction, ones of the convex portions being arranged adjacent each other in a direction substantially perpendicular to the sheet transfer direction, a concave recessed portion disposed between adjacent ones of said convex portions; and an actuating member for actuating the jump wings between a guide position in which downstream ends of the jump wings respectively protrude upward from the guide openings by a further distance than corresponding upstream ends, and a wait position in which the upstream and downstream ends of the jump wings are respectively retracted into the guide openings.

2. A sheet discharge unit according to claim 1, wherein a respective height of adjacent ones of said convex portions progressively increases laterally peripherally, and wherein at the guide position, the both sides of the sheet of pre-treated paper are guided upward such that the both sides thereof are curved to form a dropping state and the sheet of pre-treated paper is allowed to be discharged to the paper receiving tray under the dropping state, and at the wait position, the sheet of pre-treated paper is allowed to be discharged to the paper receiving tray under another dropping state without a curve to the both sides thereof.

3. A sheet discharge unit according to claim 1, wherein each of the jump wings includes a plurality of divided wing components that are laterally spaced from one another in a direction substantially perpendicular to the sheet transfer direction.

4. A sheet discharge unit according to claim 3, wherein the guide openings are respectively provided in correspondence with the plurality of divided wing components.

5. A sheet discharge unit according to claim 3, wherein shield segments are respectively provided between the plurality of divided wing components to shield a space between adjacent ones of the plurality of divided wing components.

6. A sheet discharge unit according to claim 1, wherein each of the plurality of convex portions substantially extends in the sheet transfer direction and is inclined at a given angle with respect to the sheet transfer direction, whereby the downstream end in the sheet transfer direction of each of said convex portions is disposed laterally peripherally relative to the corresponding upstream end in the sheet transfer direction of said each convex portion.

7. A sheet discharge unit according to claim 1, wherein each of the plurality of convex portions has an upper curved surface that is substantially in an arch shape having a span in a direction substantially perpendicular to the sheet transfer direction.

8. A sheet discharge unit according to claim 3, wherein the plurality of divided wing components are moveable independently from one another.

9. A sheet discharge unit according to claim 1, wherein each of the jump wings includes a plurality of convex segments that guide the sheet of pre-treated paper and concave recesses which are out of contact with the sheet of pre-treated paper, the convex segments and the concave recesses are alternately located in a direction substantially perpendicular to the sheet transfer direction.

10. A sheet discharge unit according to claim 9, wherein each of the convex segments substantially extends in the sheet transfer direction and is inclined at a given angle with respect to the sheet transfer direction, whereby the downstream end in the sheet transfer direction of each of said convex segments is disposed laterally peripherally relative to the corresponding upstream end in the sheet transfer direction of said each convex segment.

11. A sheet discharge unit according to claim 9, wherein each of the convex segments has an upper curved surface that is substantially in an arch shape having a span in a direction substantially perpendicular to the sheet transfer direction.

12. A sheet discharge unit according to claim 1, wherein the actuating member includes a wing support shaft and wing base members respectively fixed to the wing support shaft to support the jump wings and to transfer rotational motion of the wing support shaft to the jump wings.

13. A sheet discharge unit according to claim 12, wherein the actuating member further includes a spring member that urges the wing base members toward the guide position.

14. A sheet discharge unit according to claim 13, wherein the actuating member further includes an actuating lever located in the vicinity of the wing base members to actuate the jump wings toward the wait position against the force of the spring member.

15. A sheet discharge unit according to claim 1, wherein each of the jump wings includes a plurality of divided wing components, and wherein the actuating member includes a wing support shaft, a plurality of wing base members fixed to the wing support shaft that support the divided wing components, respectively, and a cam member that actuates ones of the wing base members to move said jump wings toward the guide position, respectively.

16. A sheet discharge unit according to claim 1, wherein the transfer member includes a plurality of transfer belts.

17. A sheet discharge unit according to claim 16, wherein the sheet of pre-treated paper is pressed toward the plurality of transfer belts.

18. A sheet discharge unit according to claim 1, wherein the discharge unit is used for a printing machine.

19. A sheet discharge unit comprising:

a paper receiving tray;

a transfer passage through which a sheet of pre-treated paper is transferred to the paper receiving tray along a sheet transfer direction;

a guide opening disposed on each side of the transfer passage;

a jump wing disposed in each of the guide openings, each jump wing comprising a unitary body having a plurality of laterally spaced, substantially parallel convex portions each having a longitudinal upstream end and a longitudinal downstream end, the upstream and downstream ends being aligned substantially in a sheet transfer direction, ones of the convex portions being arranged adjacent each other in a direction substantially perpendicular to the sheet transfer direction, a concave recessed portion disposed between adjacent ones of said convex portions; and an actuating member for actuating the jump wings between a guide position in which downstream ends of the jump wings respectively protrude upward from the guide openings by a further distance than corresponding upstream ends, and a wait position in which the upstream and downstream ends of the jump wings are respectively retracted into the guide openings.

20. A sheet discharge unit comprising:

a paper receiving tray;

a transfer passage through which a sheet of pre-treated paper is transferred to the paper receiving tray along a sheet transfer direction;

a plurality of guide openings disposed on each side of the transfer passage;

a plurality of independently moveable jump wing portions, each corresponding to one of said plurality of guide openings and disposed therein; and an actuating member for actuating the jump wings between a guide position in which the jump wings respectively protrude upward from the guide openings and a wait position in which the jump wings are respectively retracted into the guide openings.

* * * * *